US008050581B2

(12) United States Patent
Chang et al.

(10) Patent No.: US 8,050,581 B2
(45) Date of Patent: Nov. 1, 2011

(54) IMAGE FORMING APPARATUS AND CONTROL METHOD THEREOF

(75) Inventors: Gun Soo Chang, Suwon-Si (KR); Dong Cheol Ahn, Suwon-Si (KR)

(73) Assignee: SAMSUNG Electronics Co., Ltd, Suwon-si (KR)

( * ) Notice: Subject to any disclaimer, the term of this patent is extended or adjusted under 35 U.S.C. 154(b) by 0 days.

(21) Appl. No.: 12/624,171

(22) Filed: Nov. 23, 2009

(65) Prior Publication Data

US 2010/0135685 A1 Jun. 3, 2010

(30) Foreign Application Priority Data

Dec. 1, 2008 (KR) ..... 10-2008-0120559

(51) Int. Cl.
*G03G 15/02* (2006.01)

(52) U.S. Cl. ..... 399/50; 399/53

(58) Field of Classification Search ..... 399/38, 399/50, 53–55, 66, 130, 148–150
See application file for complete search history.

(56) References Cited

U.S. PATENT DOCUMENTS 7,593,669 B2 * 9/2009 Shigehiro ..... 399/149
7,822,356 B2 * 10/2010 Sakagawa et al. ..... 399/101
7,860,420 B2 * 12/2010 Mochizuki ..... 399/71

FOREIGN PATENT DOCUMENTS

KR 10-2000-0056309 9/2000

OTHER PUBLICATIONS

English language abstract of KR 10-2000-0056309, published Sep. 15, 2000.

* cited by examiner

*Primary Examiner* — Hoan Tran
(74) *Attorney, Agent, or Firm* — Stanzione & Kim, LLP

(57) ABSTRACT

An image forming apparatus and a control method thereof are disclosed. A charge unit charges a surface of an organic photo conductor (OPC) to a predetermined electric potential. A developing unit develops an electrostatic latent image formed on the surface of the OPC by coating a developer on the same. A power supply unit supplies power to the charge unit and the developing unit. A control unit regulates the power supplied to the charge unit and the developing unit. After a developing process in the developing unit, the control unit regulates the power applied to at least one of the charge unit and the developing unit so as to collect a residual developer on the surface of the OPC to the developing unit. Accordingly, contamination of the charge unit and the transfer unit can be prevented and an image of a good quality can be achieved.

25 Claims, 6 Drawing Sheets

IMAGE FORMING APPARATUS AND CONTROL METHOD THEREOF

CROSS-REFERENCE TO RELATED APPLICATION

This application claims the benefit of Korean Patent Application No. 10-2008-0120559, filed on Dec. 1, 2008 in the Korean Intellectual Property Office, the disclosure of which is incorporated herein by reference in its entirety.

TECHNICAL FIELD

The present disclosure relates generally to an image forming apparatus and a control method thereof, and, more particularly, to a control method for cleaning a charge roller and/or a transfer roller, and an image forming apparatus implementing the same.

BACKGROUND OF RELATED ART

An image forming apparatus refers to an apparatus configured to print an image on a printing medium in accordance with a received signal. An image forming apparatus can be classified as, for example, a printer, a copying machine, a fax machine, or a multi-function printer that can provide several functions such as printing, scanning, copying, faxing, and the like.

An electro-photographic type image forming apparatus is a kind of image forming apparatus in which light is scanned on a surface of a photosensitive member charged to a predetermined electric potential to form an electrostatic latent image on the surface of the photosensitive body. A toner can be used as a developer and can be supplied to the electrostatic latent image to form a visible toner image. The visible toner image formed on the photosensitive member can be transferred to a printing medium directly or via an intermediate transfer member. The image transferred to the printing medium can be fused to the printing medium through a fusing process.

Generally, an electro-photographic type image forming apparatus can include a cleaning device to remove residual toner from the surface of the photosensitive member by mechanically scraping the residual toner. Removing contaminants (e.g., residual toner, paper dust) from the surface of the photosensitive member by using a cleaning device can prevent a charge roller of the electro-photographic type image forming apparatus from being contaminated.

Some electro-photographic type image forming apparatuses have been recently developed that do not include a cleaning device. Such apparatuses can achieve a compact size, convenience in manufacturing, and cost savings. Such apparatuses employ a method of interrupting power applied to a charge roller and to a developing roller after completing image formation to decrease contamination of a charge roller from contaminants (e.g., residual toner, paper dust) on the surface of the photosensitive member.

By way of an example, an electro-photographic type image forming apparatus (hereinafter, referred to as "image forming apparatus" for brevity) without a cleaning device can be operated such that the photosensitive member is charged using a charge roller to which is applied a charging voltage of the same polarity as the polarity of the charged toner. Light representative of the desired image is then scanned on the surface of the charged photosensitive member by using a laser scanning unit (LSU) as an exposure unit to form an electrostatic latent image. Negatively charged toner can be coated on the photosensitive member using a developing roller by applying a negative voltage (e.g., a voltage of the same polarity as the toner) to the developing roller. The toner can be transferred to the electrostatic latent image on the photosensitive member at a nip formed between the photosensitive member and the developing roller. To transfer the toner from the surface of the photosensitive member further onto paper, a positive voltage (e.g., a voltage of opposite polarity to the polarity of the toner) can be applied to a transfer roller. The toner transferred to the paper remains attached to the paper by electrostatic force, and, when the paper is made to pass through a fusing unit, can be permanently fused to the paper by heat and pressure produced by the fusing unit. Then, the paper is discharged to a space outside the image forming apparatus through a paper discharge unit.

When the toner has a positive polarity, voltages of the opposite polarity to the afore-mentioned voltage can be applied. In other words, a positive voltage can be applied to the developing roller and a negative voltage can be applied to the transfer roller. Thus, generally speaking, a voltage of the same polarity as the polarity of the charged toner can be applied for the developing process while a voltage of an opposite polarity to the polarity of the charged toner can be applied for the transfer process.

An image forming apparatus can perform a cleaning operation in such a manner that when the movement of the paper away from the fusing unit is detected by a discharge sensor disposed, e.g., in the back-end portion of the fusing unit, the voltage applied to the charge roller and to the developing roller can be interrupted to prevent toner of an opposite polarity (e.g., positively charged toner particles) from being attached to the charge roller. The charge roller, however, can nevertheless be contaminated by paper dust and/or toner from multiple image forming operations. When the charge roller becomes contaminated, the charging performance of the photosensitive member can deteriorate, and may result, in poor image quality or even in image defects.

The contamination of the charge roller or of the transfer roller by the residual toner on the photosensitive member can adversely impact the charging operations and/or result in the contamination of the back surface of the paper during the transfer process. Furthermore, a degradation of image quality in the form of a background image forming during the developing process may also occur because the toner on a non-image area is not properly collected.

SUMMARY OF THE DISCLOSURE

In accordance with one aspect of the present invention, there is provided an image forming apparatus that may include a charge unit, a developing unit, a power supply unit and a control unit. The charge unit may be configured to charge a surface of an organic photo conductor (OPC) to a predetermined electric potential during a charging operation. The developing unit may be configured to develop an electrostatic latent image formed on the surface of the OPC by applying developer on the electrostatic latent image during a developing operation. The power supply unit may be configured to supply voltages to the charge unit and the developing unit. The control unit may be configured to control the voltages supplied to the charge unit and the developing unit. The control unit may be configured to control the power supply such that a charging voltage is supplied to the charging unit during the charging operation, and such that a developing voltage is supplied to the developing unit during the developing operation. During a non image forming operation in which no image is formed, the control unit may be configured to control the power supply unit so as to cause at least one of the charge unit and the developing unit to be supplied with a voltage that is different from a normal charge voltage that is supplied to the charge unit during the charging operation and from a normal developing voltage that is supplied to the developing unit during the developing operation.

In one example, the control unit may cause the voltage to be supplied to the charge unit during a residual developer collection operation to reduce a contamination of the charge unit from residual developer remaining on the surface of the OPC.

In such example, the image forming apparatus may further comprise a transfer unit that may be configured to transfer a toner image developed on the surface of the OPC to a printing medium during a transfer operation. The control unit may further be configured to control the power supply unit such that a transfer voltage is supplied to transfer unit during the transfer operation, and such that a reverse voltage having a polarity opposite to that of the transfer voltage during the residual developer collection operation. During the residual developer collection operation, the control unit may cause the voltage to be supplied to the charging unit during a time duration in which a point on the surface of the OPC moves from the transfer unit to the charge unit after an application of the reverse voltage to the transfer unit.

In another example, the control unit may causes the voltage to be supplied to the developing unit during a residual developer collection operation to allow the developing unit to collect residual toner from the surface of the OPC.

In such example, the image forming apparatus may further comprise a transfer unit configured to transfer a toner image developed on the surface of the OPC to a printing medium during a transfer operation. The control unit may further be configured to control the power supply unit such that a transfer voltage is supplied to transfer unit during the transfer operation, and such that a reverse voltage having a polarity opposite to that of the transfer voltage during the residual developer collection operation. During the residual developer collection operation, the control unit may cause the voltage to be supplied to the developing unit during a time duration in which a point on the surface of the OPC moves from the transfer unit to the developing unit after an application of the reverse voltage to the transfer unit.

In yet another alternative example, during the non-image forming operation, the control unit may causes a first voltage that is different from the normal developing voltage to be supplied to the developing unit and a second voltage that is different from the normal charge voltage to be supplied to the charge unit.

In such example, the image forming apparatus may further comprise a transfer unit configured to transfer a toner image developed on the surface of the OPC to a printing medium during a transfer operation. The control unit may further be configured to control the power supply unit such that a transfer voltage is supplied to transfer unit during the transfer operation, and such that a reverse voltage having a polarity opposite to that of the transfer voltage during the non-image forming operation. During the non-image forming operation, the control unit may causes the second voltage to be supplied to the charging unit during a first time duration in which a point on the surface of the OPC moves from the transfer unit to the charge unit after an application of the reverse voltage to the transfer unit. During the non-image forming operation, the control unit may cause the first voltage to be supplied to the developing unit during a second time duration in which the point on the surface of the OPC moves from the transfer unit to the developing unit after the application of the reverse voltage to the transfer unit.

The image forming apparatus according to an embodiment may further comprise a transfer unit configured to transfer a toner image developed on the surface of the OPC to a printing medium during a transfer operation. The control unit may be configured to cause a transfer voltage to be supplied to the transfer unit during the transfer operation, and may be configured to cause a reverse voltage having a polarity opposite to that of the transfer voltage to be supplied to the transfer unit during the non-image forming operation.

The non-image forming operation may occur at least one of before and after a charge unit cleaning operation, during which the cleaning unit is cleaned.

The control unit may be configured to cause a low voltage substantially close to zero volts to be applied to the charge unit and to the developing unit during the charge unit cleaning operation.

The control unit may cause the low voltage to be supplied to the charge unit prior to supplying the low voltage to the developing unit.

Alternatively, the control unit may be configured to power off the developing unit and the charge unit during the charge unit cleaning operation.

According to another aspect of the present disclosure, a method of controlling an image forming apparatus may be provided. The image forming apparatus may includes a charge unit, a developing unit and an organic photo conductor (OPC), and may have an image forming mode in which a developer image is formed on the OPC and a non-image-forming mode in which no image is formed. The method may comprise determining whether the image forming apparatus is in the non-image-forming mode; and when the image forming apparatus is in the non-image-forming mode, regulating a supply of voltage to at least one of the charge unit and the developing unit so as to cause the developer unit to collect residual developer from a surface of the OPC.

The step of regulating the supply of voltage may comprise supplying a first voltage to the charge unit, the first voltage having a larger absolute value than a charging voltage that is applied to the charge unit when the image forming apparatus is in the image forming mode; and supplying a second voltage to the developing unit, the second voltage having a smaller absolute value than a developing voltage that is applied to the developing unit when the image forming apparatus is in the image forming mode.

The image forming apparatus may further include a transfer unit configured to transfer the developer image formed on the OPC to a printing medium. The first voltage may be applied to the charge unit within a first duration of time in which a point on the surface of the OPC moves from a first location adjacent the transfer unit to a second location adjacent the charge unit. The second voltage may be applied to the developing unit within a second time duration in which the point on the surface of the OPC moves from the second location adjacent the charge unit to a third location adjacent the developing unit.

Alternatively, the step of regulating the supply of voltage may comprise supplying a first voltage to the charge unit, the first voltage having a larger absolute value than a charging voltage that is applied to the charge unit when the image forming apparatus is in the image forming mode.

The image forming apparatus may further include a transfer unit configured to transfer the developer image formed on the OPC to a printing medium. In this example, the method may further comprise supplying a third voltage to the transfer unit when the image forming apparatus is in the non-image-forming mode. The third voltage may have a polarity opposite to that of the transfer voltage that is supplied to the transfer unit during the transfer of the developer image formed on the OPC to the printing medium. The first voltage may be applied to the charge unit within a time duration in which a point on the surface of the OPC moves from a first location adjacent the transfer unit to a second location adjacent the charge unit after supplying of the third voltage to the transfer unit has begun.

As another example, the step of regulating the supply of voltage may comprise supplying a second voltage to the developing unit, the second voltage having a smaller absolute value than a developing voltage that is applied to the developing unit when the image forming apparatus is in the image forming mode.

The image forming apparatus may further include a transfer unit configured to transfer the developer image formed on the OPC to a printing medium. In this example, the method may further comprise supplying a third voltage to the transfer unit when the image forming apparatus is in the non-image-forming mode. The third voltage may have a polarity opposite to that of the transfer voltage that is supplied to the transfer unit during the transfer of the developer image formed on the OPC to the printing medium. The second voltage may be applied to the developing unit within a time duration in which a point on the surface of the OPC moves from a first location adjacent the transfer unit to a second location adjacent the developing unit after supplying of the third voltage to the transfer unit has begun.

In another example, the image forming apparatus may further include a transfer unit configured to transfer the developer image formed on the OPC to a printing medium. The method may further comprise supplying a third voltage to the transfer unit when the image forming apparatus is in the non-image-forming mode. The third voltage may have a polarity opposite to that of the transfer voltage that is supplied to the transfer unit during the transfer of the developer image formed on the OPC to the printing medium.

The method may further comprise cleaning the charge unit. The step of regulating the supply of voltage when the image forming apparatus is in the non-image-forming mode may be performed at least one of before and after the step of cleaning the charge unit.

The step of cleaning the charge unit may comprise interrupting voltage supply to the charge unit and to the developing unit.

The step of interrupting voltage supply may comprise interrupting voltage supply to the charge unit first prior to interrupting voltage supply to the developing unit.

According to yet another aspect, a method of controlling an image forming apparatus may be provided. The image forming apparatus may includes a charge unit, a developing unit and an organic photo conductor (OPC), and may have an image forming mode in which a developer image is formed on the OPC and a non-image-forming mode in which no image is formed. The method may comprise determining whether the image forming apparatus is in the non-image-forming mode; and when the image forming apparatus is in the non-image-forming mode, supplying a first voltage to the charge unit, the first voltage having a larger absolute value than a charging voltage that is applied to the charge unit when the image forming apparatus is in the image forming mode; supplying a second voltage to the developing unit, the second voltage having a smaller absolute value than a developing voltage that is applied to the developing unit when the image forming apparatus is in the image forming mode; and cleaning the charge unit by interrupting voltage supply to the charge unit and to the developing unit.

The step of cleaning the charge unit may comprise interrupting voltage supply to the charge unit first prior to interrupting voltage supply to the developing unit.

BRIEF DESCRIPTION OF THE DRAWINGS

Various aspects and advantages of the disclosure will become apparent and more readily appreciated from the following description of the embodiments, taken in conjunction with the accompanying drawings, in which.

DETAILED DESCRIPTION OF SEVERAL EMBODIMENTS

Figure 1:
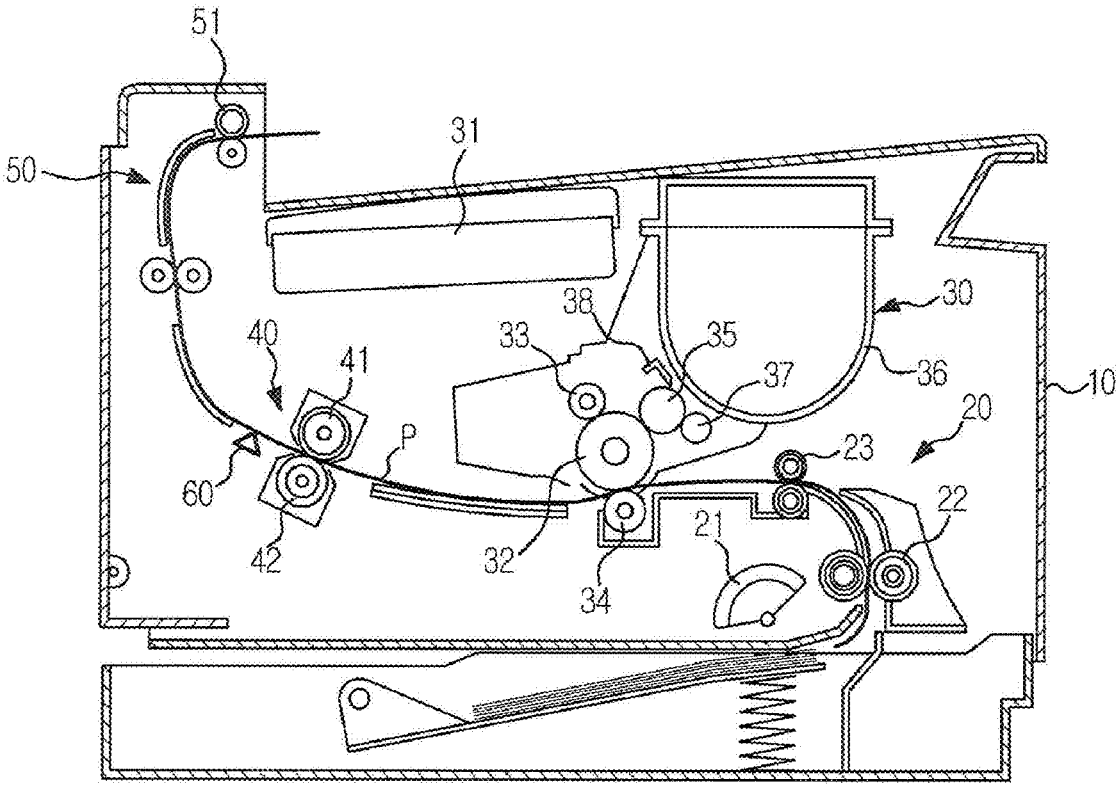
FIG. 1 is a schematic cross-sectional view of an image forming apparatus according to an embodiment of the present disclosure.

Reference will now be made in detail to the embodiments of the present disclosure, examples of which are illustrated in the accompanying drawings, wherein like reference numerals refer to the like elements throughout. The embodiments are described below by referring to the figures. The terms "electric potential" and "voltage" may be used interchangeably in the several embodiments described below.

FIG. 1 schematically shows a cross section of an image forming apparatus according to an embodiment of the present disclosure. As shown in FIG. 1, an image forming apparatus can include a main body 10 that may define the external appearance of the image forming apparatus, a printing medium feeding unit 20 configured to feed a printing medium P into the main body 10, an image forming unit 30 configured to form an image on the printing medium P fed from the printing medium feeding unit 20, a fusing unit 40 configured to fuse the image formed in the image forming unit 30 to the printing medium P, and a printing medium discharge unit 50 configured to discharge the printing medium P from the fusing unit 40 to a space outside the main body 10.

The printing medium feeding unit 20 can include a pickup roller 21 configured to pick up the printing medium P loaded on a tray one sheet at a time, a feed roller 22 configured to guide the printing medium P picked up by the pickup roller 21, and a registration roller 23 configured to align the leading edge of the printing medium P fed by the pickup roller 21.

The image forming unit 30 can include a rotatable organic photo conductor (OPC) 32 in which to form an electrostatic latent image by a laser scanning unit (LSU) 31 that generates a laser beam based on a received digital image signal. The OPC 32 can be configured to rotatably contact a charge roller 33, which can operate as a charge unit configured to charge the OPC 32 to a predetermined electric potential before an exposure process. The OPC 32 can be configured to rotatably contact a transfer roller 34, which can operate as a transfer unit configured to form an image on a printing medium, and a developing roller 35, which can operate as a developing unit configured to develop an electrostatic latent image formed on the OPC 32 by coating a quantity of toner on the same. The developing roller 35 can be configured to rotatably contact a supply roller 37, which can operate as a toner supply unit having a constant contact area and configured to supply toner as the developer from a toner container 36. The supply roller 37 can rotate in the same direction as the developing roller 35 to friction-charge the toner, and can supply the toner to the developing roller 35. A doctor blade 38 configured to produce a uniform toner layer thickness on the developing roller 35 can be disposed above the developing roller 35. One end of the doctor blade 38 can be fixed to a frame or other component in the main body 10 while the other end of the doctor blade 38 can be in contact with the developing roller 35.

The fusing unit 40 can include a heating roller 41 configured to heat toner particles on the printing medium P and a pressure roller 42 configured to rotatably contact the heating roller 41 with a constant pressing force to fuse the toner image formed in the image forming unit 30 to the printing medium P. The toner image transferred to the printing medium P can be fused to the printing medium P by heat and pressure when the printing medium P passes between the heating roller 41 and the pressure roller 42.

The printing medium discharge unit 50 can include a discharge roller 51 configured to discharge the printing medium P that has passed through the fusing unit 40 to a space outside of the main body 10.

The image forming apparatus can further include a discharge sensor 60 mounted in a back-end portion of the fusing unit 40. The discharge sensor 60 may be configured to sense the printing medium P passing through the fusing unit 40.

The image forming apparatus can further include a driving source (not shown) to generate a driving force and a power supply unit 80 (see FIG. 2) configured to supply power (e.g., voltage and/or current) to the charge roller 33, the developing roller 35, the transfer roller 34 and/or the fusing unit 40. The image forming apparatus may also include a control unit 70 (see FIG. 2) configured to control the operations for the image forming apparatus.

Figure 2:
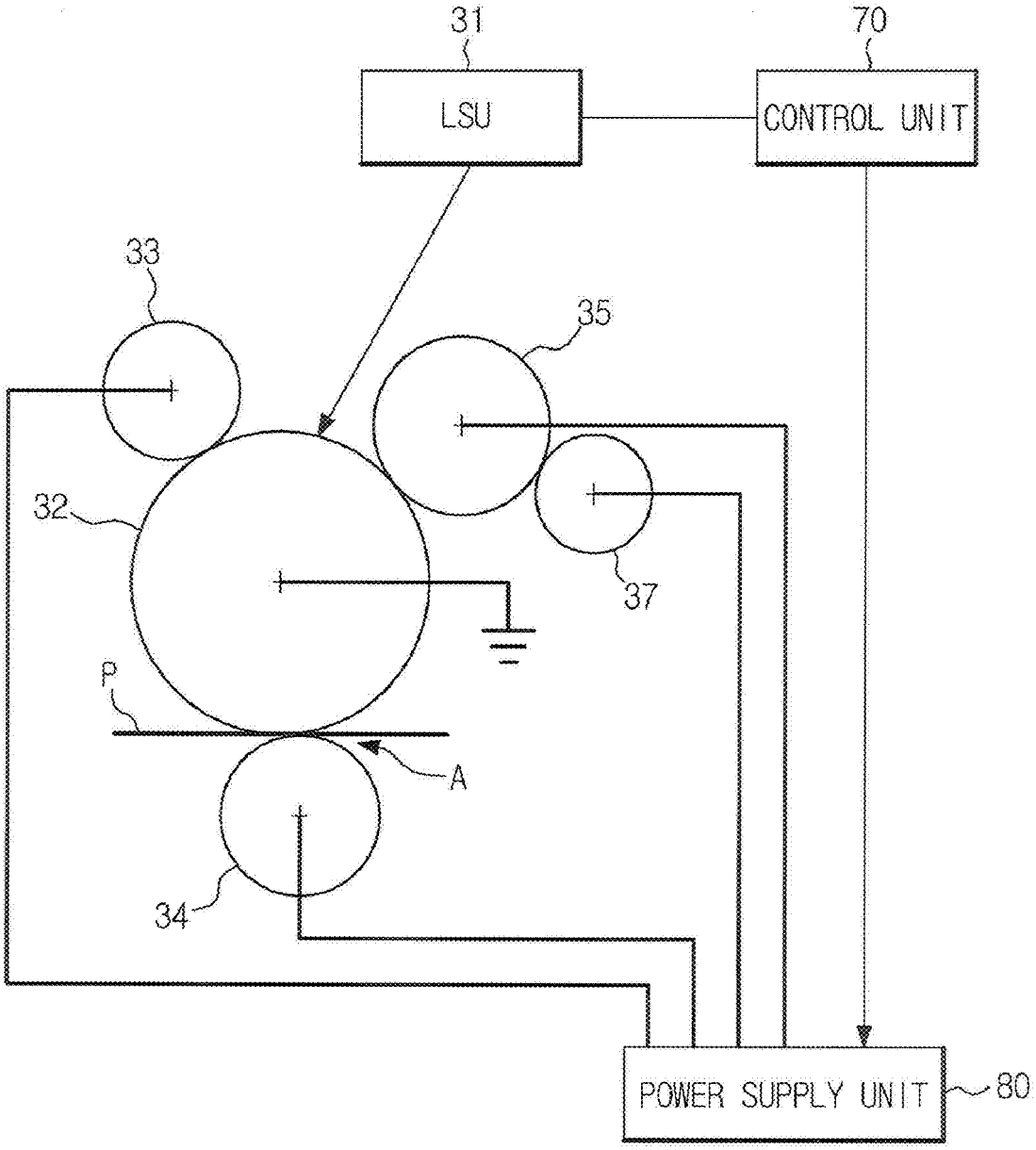
FIG. 2 is a schematic control block diagram of the image forming apparatus according to an embodiment of the present disclosure.

FIG. 2 is a schematic control block diagram of the image forming apparatus according to an embodiment the present disclosure. As shown in FIG. 2, the image forming apparatus can include the control unit 70 and the power supply unit 80. The power supply unit 80 can be configured to apply suitable voltages to one or more of the charge roller 33, the transfer roller 34, the developing roller 35 and the supply roller 37. In one embodiment of the image forming process, the power supply unit 80 can apply a negative voltage to the charge roller 33. The charge roller 33 receiving the negative voltage can charge the surface of the OPC 32 to a negative electric potential. An electric potential difference can be generated on the surface of the OPC 32 by exposure to the light from the LSU 31, and result in a formation of an electrostatic latent image on such surface of the OPC 32. The toner supplied by the developing roller 35 can be coated on the surface of the OPC 32 to develop the electrostatic latent image on the surface into a toner image. The toner image on the OPC 32 can be transferred to the printing medium P at a transfer nip A formed by the contact between the OPC 32 and the transfer roller 34. The transfer roller 34 can receive a positive voltage when performing the transfer of the toner image to the printing medium P.

In a non-image-forming mode (i.e., a mode in which an image is not being formed, e.g., during a standby period), the control unit 70 can produce an electric potential difference between the OPC 32 and the developing roller 35 larger than the normal or typical electric potential difference that would be provided during the electrostatic latent image development process. The larger potential difference may enable the developing roller 35 to collect the residual toner remaining on the surface of the OPC 32. To produce a larger electric potential difference between the OPC 32 and the developing roller 35, the control unit 70 can apply to the charge roller 33 a voltage having an absolute value larger than the normal or typical value of the charging voltage. The control unit 70 can also apply to the developing roller 35 a voltage having an absolute value smaller than the normal value of the developing voltage. Alternatively, when applying a voltage having an absolute value larger than the normal value of the charging voltage to the charge roller 33, the control unit 70 can also apply to the developing roller 35 a voltage having an absolute value smaller than the normal value of the developing voltage. As such, based on the particular features and/or operations of the image forming apparatus, a suitable toner collecting method can be adaptively used.

By way of an example, below is a description of a method for collecting residual toner on the surface of the OPC 32 by the developing roller 35 during a non-image-forming mode in which a voltage having an absolute value smaller than the normal value of the developing voltage is applied to the developing roller 35 and a voltage having an absolute value larger than the normal value of the charging voltage is applied to the charge roller 33.

Figure 3:
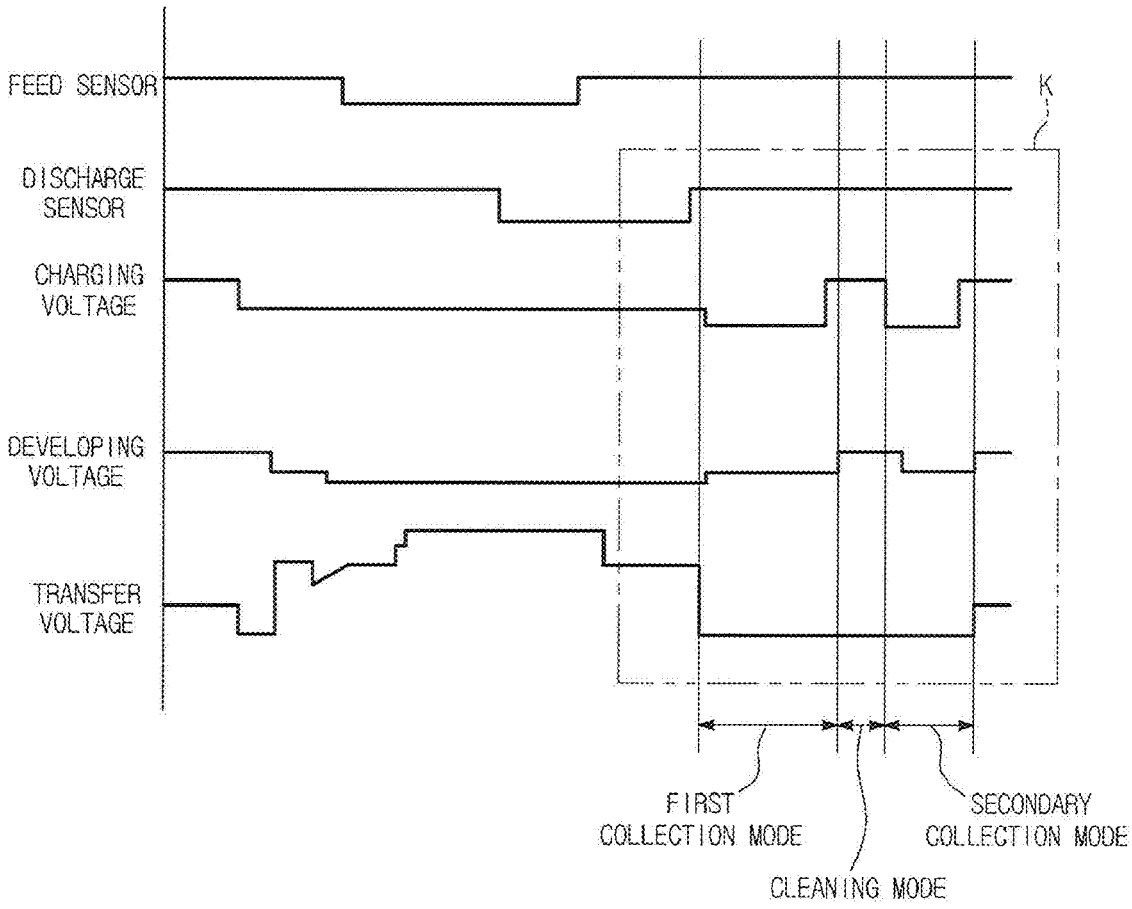
FIG. 3 is a control timing chart of the image forming apparatus according to an embodiment of the present disclosure.
Figure 4:
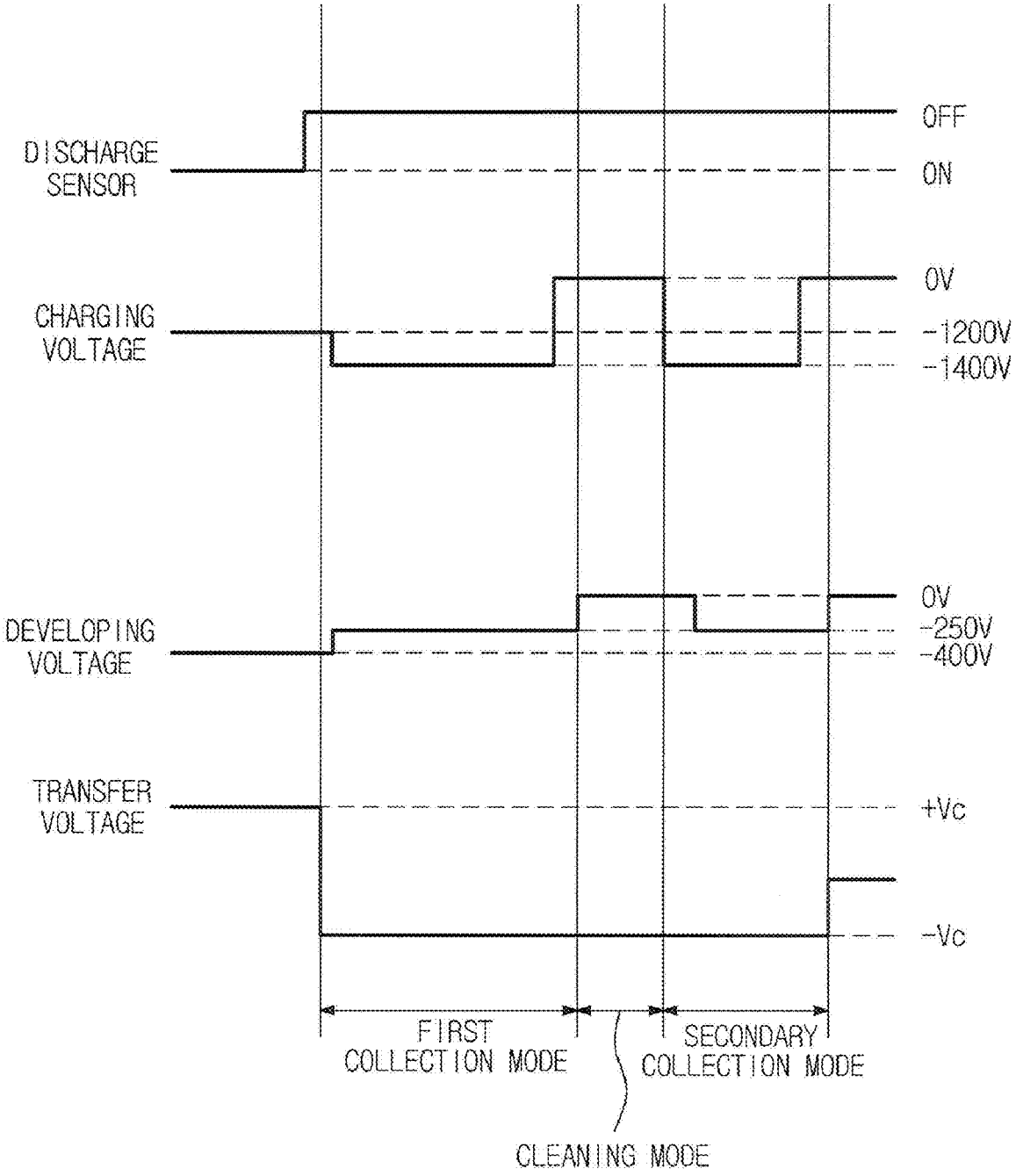
FIG. 4 is an enlarged view showing a control timing of some components depicted in FIG. 3.

FIG. 3 is a timing chart of the image forming operation in the image forming apparatus according to an embodiment of the present disclosure. FIG. 4 is an enlarged view showing a control timing of some components shown in FIG. 3. An ON/OFF timing of the discharge sensor 60, the applied voltages, and timing of the application of the voltages to the charge roller 33, the developing roller 35 and the transfer roller 34 are described below.

Referring to FIGS. 3 and 4, when the discharge sensor 60 is switched to an OFF state from an ON state, a voltage of about −1400 volts (V), which has an absolute value larger than a normal or typical value of the charging voltage of about −1200 V, can be applied to the charge roller 33 (see Charging Voltage in FIG. 4). Because the residual toner on the surface of the OPC 32 can include a toner having a polarity (e.g., positive toner particles) opposite to the typical polarity of the toner (e.g., negative polarity), the toner having opposite polarity can attach to the charge roller 33. Therefore, when a voltage having an absolute value (e.g., −1400 V) larger than a normal value of the charging voltage (e.g., −1200 V) is applied to the charge roller 33, the toner having opposite polarity on the surface of the OPC 32 does not attach to the charge roller 33 but can remain on the surface of the OPC 32.

After a charging voltage of about −1400 V is applied to the charge roller 33, a voltage of about −250 V, which has an absolute value smaller than a normal or typical value of the developing voltage of about −400 V, can be applied to the developing roller 35 (see Developing Voltage in FIG. 4). Such a developing voltage can produce a larger than typical electric potential difference between the OPC 32 and the developing roller 35 to improve collection of the toner.

Accordingly, in a first toner collection mode (see First Collection Mode in FIG. 4), when a voltage having an absolute value larger than the normal value of the charging voltage is applied to the charge roller 33 and a voltage having an absolute value smaller than the normal value of the developing voltage is applied to the developing roller 35, the residual toner on the surface of the OPC 32 can be collected by the developing roller 35 to prevent contamination of the charge roller 33.

After the first toner collection mode, in the cleaning mode, in which the charge roller 33 is to be cleaned (see Cleaning Mode in FIG. 4), an electric potential is not applied to the charge roller 33 and to the developing roller 35, or alternatively a voltage having an absolute value smaller than a normal value of a voltage that is applied to the charge roller 33 and to the developing roller 35 can be applied to the charge roller 33 and to the developing roller 35 to clean the charge roller 33. In some embodiments, such a cleaning mode can be performed before the first toner collection mode.

After the charge roller cleaning mode, a secondary toner collection mode (see Secondary Collection Mode in FIG. 4) can be performed in substantially the same manner as the first toner collection mode.

To prevent the residual toner on the surface of the OPC 32 from being transferred to the transfer roller 34 during the first and secondary toner collection modes, the transfer voltage applied to the transfer roller 34 can be changed from a positive cleaning voltage (e.g., +Vc) to a negative cleaning voltage (e.g., −Vc) (see Transfer Voltage in FIG. 4). By changing the transfer voltage in such a manner, contamination of the transfer roller 34 can be prevented. The normal or typical charging voltage and developing voltage substantially refer to the voltages applied to the respective rollers during the image forming operation. The normal charging voltage and developing voltage can partially change according to environmental conditions (e.g., temperature, humidity) during the operation of the image forming apparatus.

When a voltage is applied to the developing roller 35, a more effective toner collection can occur by turning the developing electric potential substantially OFF during the toner collection mode. When the developing voltage is turned substantially OFF, however, excessive mechanical stress can be produced on the components of the image forming unit 30. The toner that exists on the developing roller 35 can function as a lubricant for the supply roller 37 and/or the doctor blade 38, which are disposed adjacent to the developing roller 35. When there is no toner because the applied developing voltage is substantially OFF, the developing roller 35 can be subjected to excessive mechanical stress from the doctor blade 38 and/or the supply roller 37, which can cause mechanical deformation and/or deterioration of anti-abrasion properties of the components. A 'streak' phenomenon can occur in the image forming process as a result of the stress that is applied to the developing roller 35. Therefore, having a predetermined small amount of toner attached to the developing roller 35 during the non-image-forming mode may be preferred. Thus, to achieve the above-described operation, a very low developing voltage can be applied or alternatively the power to the developing roller 35 can be turned OFF entirely during toner collection. Maintaining a minimum developing voltage, however, may be preferable.

Figure 5:
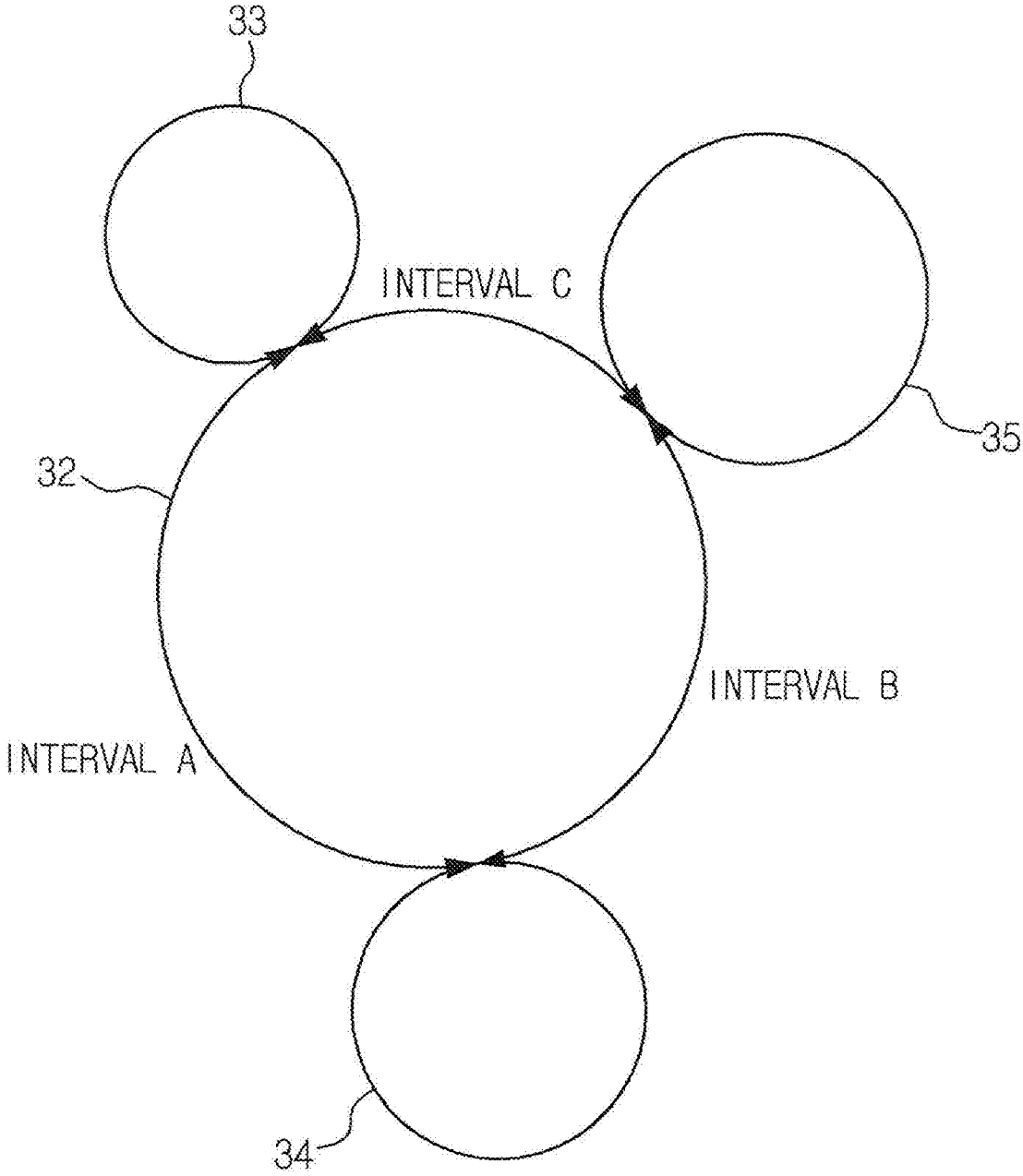
FIG. 5 is a view explaining timing of voltage application to a charge roller and a developing roller in an image forming apparatus according to an embodiment of the present disclosure.

FIG. 5 is a view describing the timing associated with applying a voltage to the charge roller and/or to the developing roller in the image forming apparatus according to an embodiment of the present disclosure. The points or instants in time when to apply the charging voltage and/or the developing voltage are described below with reference to FIGS. 4 and 5.

For the charge roller 33, when the image forming operation is completed, the transfer voltage applied to the transfer roller 34 can be changed to a negative cleaning voltage (e.g., −Vc) from a positive cleaning voltage (e.g., +Vc). The charging voltage of the charge roller 33 can be changed to a voltage having an absolute value larger than the normal value of the charging voltage within an interval that is consistent with the following equation:

$$(\text{point in time of changing the charging voltage} - \text{point in time of changing transfer voltage}) \times \text{process speed} \leqq \text{interval } A \text{ of OPC.} \quad \text{Equation (1)}$$

The interval A of the OPC 32 refers to a distance between a contact point of the OPC 32 and the transfer roller 34 and a contact point of the OPC 32 and the charge roller 33. The process speed in Equation (1) refers to the rotational speed of the OPC 32.

As provided in the above Equation (1), a voltage having an absolute value larger than the normal value of the charging voltage can be applied to the charge roller 33 within a time it takes for the OPC 32 to move from the contact point with the transfer roller 34 to the contact point with the charge roller 33 from a point in time when the transfer voltage of the transfer roller 34 is changed from a positive voltage to a negative voltage. When the transfer voltage of the transfer roller 34 is change to a negative voltage from a positive voltage, negatively charged toner attached to the transfer roller 34 can be transferred to the surface of the OPC 32 and the amount of residual toner on the surface of the OPC 32 can thus increase. When the OPC 32 further rotates so that the contact point of the OPC 32 and the transfer roller 34 at which the residual toner attached to the OPC 32 reaches the contact point of the OPC 32 and the charge roller 34, the charge roller 34 can be contaminated by the residual toner. Therefore, the change in the voltage applied to the charge roller 33 can be performed within the time it takes for the OPC 32 to move from the contact point with the transfer roller 34 to the contact point with the charge roller 33 from a point in time when the transfer voltage of the transfer roller 34 is changed to a negative voltage from a positive voltage.

For the developing roller 35, when the image forming operation is completed, the voltage of the charge roller 33 can be changed to a voltage having an absolute value larger than the normal value of the charging voltage. The voltage applied to the developing roller 35 can be changed into a voltage having an absolute value smaller than the normal value of the developing voltage within an interval that is consistent with the following equation:

$$(\text{point in time of changing the developing voltage} - \text{point in time of changing the charging voltage}) \times \text{process speed a interval } C \text{ of OPC.} \quad \text{Equation (2)}$$

The interval C of the OPC 32 refers to a distance between a contact point of the OPC 32 and the charge roller 33 and a contact point of the OPC 32 and the developing roller 35.

As provided in the above Equation (2), a voltage having an absolute value smaller than the normal value of the developing voltage can be applied to the developing roller 35 at a point in time when the time that it takes for the OPC 32 to move from the contact point with the charge roller 33 to the contact point with the developing roller 35 has elapsed from a point in time when a voltage having an absolute value larger than the normal value of the charging voltage is applied to the charge roller 33. In other words, a voltage having an absolute value smaller than the normal value of the developing voltage can be applied to the developing roller 35 within the time it takes for the OPC 32 to move from the contact point with the transfer roller 34 to the contact point with the developing roller 35 from a point in time when the transfer voltage of the transfer roller 34 is change from a positive voltage to a negative voltage.

Figure 6:
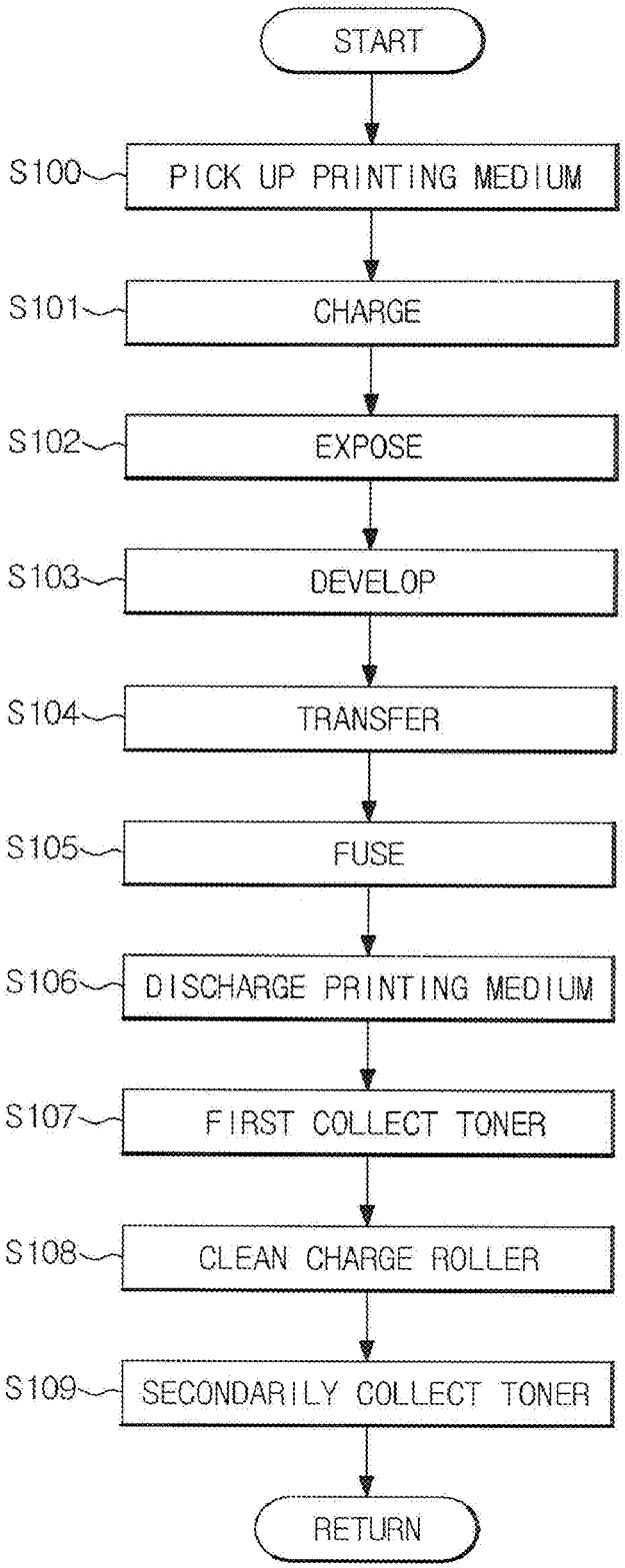
FIG. 6 is a control flow chart showing a method for controlling the image forming apparatus according to an embodiment of the present disclosure.

FIG. 6 is a flow chart showing a method for controlling the image forming apparatus according to an embodiment of the present disclosure. Referring to FIG. 6, the printing medium P can be picked up by the printing medium feeding unit 20 at S100. The OPC 32 can be charged by applying a negative charging voltage to the charge roller 33 at S101. To form an electrostatic latent image on the OPC 32, an exposure process can be performed by scanning light onto the surface of the charged OPC 32 using the LSU 31 at S102. Thereafter, a developing process can be performed by applying the charged toner having a negative polarity on the OPC 32 through the application of a negative developing voltage to the developing roller 35 at S103. The charged toner having a negative polarity on the OPC 32 can be transferred to the printing medium P by applying a positive voltage (i.e., a voltage having polarity opposite to the polarity of the toner) to the transfer roller 34 at S104. The toner image transferred to the printing medium P can be fused to the printing medium P by a fusing process using the fusing unit 40 at S105. Thereafter, the printing medium P, on which the image is printed, can be discharged through the printing medium discharge unit 50 at S106.

When the printing medium is discharged, the discharge sensor 60 disposed in the back-end portion of the fusing unit 40 can switch from an ON state to an OFF state. When the discharge sensor 60 switches to the OFF state, that is, during a non-image-forming mode, the first toner collection can be performed in the following manner during the first toner collection mode at S107. A voltage of about −1400 V, which has an absolute value larger than the normal value of the charging voltage of about −1200 V, can be applied to the charge roller 33 so that the charged toner having the negative polarity can be transferred to the OPC 32 and prevent the toner from being stuck or attached to the charge roller 33. Moreover, by applying a voltage of about −250 V, which has an absolute value smaller than the normal value of the developing voltage of about −400 V, to the developing roller 35 so that the toner on the OPC 32 can be transferred to the developing roller 35. Preferably, the change in the charging voltage should take place at the time it takes for the OPC 32 to move from the contact point with the transfer roller 34 to the contact point with the charge roller 33 from a point in time when the transfer voltage of the transfer roller 34 is converted from a positive voltage to a negative voltage. Also, it may be preferable to change the voltage applied to the developing roller 35 to a voltage having an absolute value smaller than the normal value of the developing voltage at a point in time when the time it takes for the OPC 32 to move from the contact point with the charge roller 33 to the contact point with the developing roller 35 has elapsed from a point in time when the voltage applied the charge roller 33 is converted to a voltage having an absolute value larger than the normal value of the charging voltage.

After the first toner collection mode, the charge roller 33 can be cleaned during the cleaning mode at S108. The voltages applied to the charge roller 33 and the developing roller 35 can be temporarily interrupted. In one embodiment, after the voltage applied to the charge roller 33 is interrupted to clean the charge roller 33, the voltage applied to the developing roller 35 can be interrupted. This approach can be used to prevent toner from being supplied to the OPC 32 from the developing roller 35 where the voltage applied to the developing roller 35 is interrupted prior to the interruption of the voltage applied to the charge roller 33.

After the charge roller cleaning mode, at S109, the secondary toner collection can be performed in substantially the same manner as the first toner collection mode. To prevent the toner from being transferred to the transfer roller 34 during the first and secondary toner collection modes, a negative cleaning voltage (e.g., −Vc) as the transfer voltage can be applied to the transfer roller 34, thereby preventing contamination of the transfer roller 34.

Although it has been described that the toner collection operation can be performed both before and after the operation of cleaning the charge roller 33, it should be understood that the order of these operations need not be, so limited. For example, the charge roller cleaning operation can be performed after the second toner collection operation or before the first toner collection operation.

Moreover, although it has been described that the toner has a negative polarity, voltages of polarities opposite to the foregoing descriptions with respect to the negatively charged toner when the toner used has a positive polarity. In so far as a voltage of the same polarity as the polarity of the toner is applied in the developing process and a voltage of an opposite polarity to the polarity of the toner is applied in the transfer process, it will be apparent to those skilled in the art that the same effect as the above-described embodiments can be obtained.

As is apparent from the above description, the image forming apparatus and the control method thereof according to the present disclosure can be used to prevent contamination of the charge unit and the transfer unit by collecting the residual developer on the OPC after the transfer to the developing unit by regulating the power applied to at least one of the charge roller and the developing roller. Accordingly, deterioration of the charging features of the charge unit and contamination of a back surface of a printing medium because of the transfer unit can be prevented to produce an image of a good quality.

Although several embodiments have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus, comprising:

a charge unit configured to charge a surface of an organic photo conductor (OPC) to a predetermined electric potential during a charging operation;

a developing unit configured to develop an electrostatic latent image formed on the surface of the OPC by applying developer on the electrostatic latent image during a developing operation;

a power supply unit configured to supply voltages to the charge unit and the developing unit; and a control unit configured to control the voltages supplied to the charge unit and the developing unit, such that during a non image forming operation in which no image is formed, the control unit is configured to control the power supply unit to cause at least one of the charge unit and the developing unit to be supplied with a voltage that is different from a normal charge voltage that is supplied to the charge unit during the charging operation and from a normal developing voltage that is supplied to the developing unit during the developing operation, such that an absolute value of the voltage that is different from the normal charge voltage is larger than that of the normal charge voltage.

2. The image forming apparatus according to claim 1, wherein the control unit causes the voltage to be supplied to the charge unit during a residual developer collection operation to reduce a contamination of the charge unit from residual developer remaining on the surface of the OPC.

3. The image forming apparatus according to claim 2, further comprising:

a transfer unit configured to transfer a toner image developed on the surface of the OPC to a printing medium during a transfer operation, wherein the control unit is further configured to control the power supply unit such that a transfer voltage is supplied to transfer unit during the transfer operation, and such that a reverse voltage having a polarity opposite to that of the transfer voltage during the residual developer collection operation, and wherein, during the residual developer collection operation, the control unit causes the voltage to be supplied to the charging unit during a time duration in which a point on the surface of the OPC moves from the transfer unit to the charge unit after an application of the reverse voltage to the transfer unit.

4. The image forming apparatus according to claim 1, wherein, during the non-image forming operation, the control unit causes a first voltage that is different from the normal developing voltage to be supplied to the developing unit and a second voltage that is different from the normal charge voltage to be supplied to the charge unit.

5. The image forming apparatus according to claim 4, further comprising:

a transfer unit configured to transfer a toner image developed on the surface of the OPC to a printing medium during a transfer operation, wherein the control unit is further configured to control the power supply unit such that a transfer voltage is supplied to transfer unit during the transfer operation, and such that a reverse voltage having a polarity opposite to that of the transfer voltage during the non-image forming operation, wherein, during the non-image forming operation, the control unit causes the second voltage to be supplied to the charging unit during a first time duration in which a point on the surface of the OPC moves from the transfer unit to the charge unit after an application of the reverse voltage to the transfer unit, and wherein, during the non-image forming operation, the control unit causes the first voltage to be supplied to the developing unit during a second time duration in which the point on the surface of the OPC moves from the transfer unit to the developing unit after the application of the reverse voltage to the transfer unit.

6. The image forming apparatus according to claim 1, further comprising:

a transfer unit configured to transfer a toner image developed on the surface of the OPC to a printing medium during a transfer operation, wherein the control unit is configured to cause a transfer voltage to be supplied to the transfer unit during the transfer operation, and to cause a reverse voltage having a polarity opposite to that of the transfer voltage to be supplied to the transfer unit during the non-image forming operation.

7. The image forming apparatus according to claim 1, wherein the non-image forming operation occurs at least one of before and after a charge unit cleaning operation, during which the charging unit is cleaned.

8. The image forming apparatus according to claim 7, wherein the control unit is configured to cause a low voltage substantially close to zero volts to be applied to the charge unit and to the developing unit during the charge unit cleaning operation.

9. The image forming apparatus according to claim 8, wherein the control unit cause the low voltage to be supplied to the charge unit prior to supplying the low voltage to the developing unit.

10. The image forming apparatus according to claim 7, wherein the control unit is configured to power off the developing unit and the charge unit during the charge unit cleaning operation.

11. An image forming apparatus, comprising:

a charge unit configured to charge a surface of an organic photo conductor (OPC) to a predetermined electric potential during a charging operation;

a developing unit configured to develop an electrostatic latent image formed on the surface of the OPC by applying developer on the electrostatic latent image during a developing operation;

a power supply unit configured to supply voltages to the charge unit and the developing unit; and a control unit configured to control the voltages supplied to the charge unit and the developing unit, wherein, during a non image forming operation in which no image is formed, the control unit is configured to control the power supply unit to cause at least one of the charge unit and the developing unit to be supplied with a voltage that is different from a normal charge voltage that is supplied to the charge unit during the charging operation and from a normal developing voltage that is supplied to the developing unit during the developing operation, and wherein the control unit causes the voltage to be supplied to the developing unit during a residual developer collection operation to allow the developing unit to collect residual toner from the surface of the OPC.

12. The image forming apparatus according to claim 11, further comprising:

a transfer unit configured to transfer a toner image developed on the surface of the OPC to a printing medium during a transfer operation, wherein the control unit is further configured to control the power supply unit such that a transfer voltage is supplied to transfer unit during the transfer operation, and such that a reverse voltage having a polarity opposite to that of the transfer voltage during the residual developer collection operation, and wherein, during the residual developer collection operation, the control unit causes the voltage to be supplied to the developing unit during a time duration in which a point on the surface of the OPC moves from the transfer unit to the developing unit after an application of the reverse voltage to the transfer unit.

13. A method of controlling an image forming apparatus that includes a charge unit, a developing unit and an organic photo conductor (OPC), the image forming apparatus having an image forming mode in which a developer image is formed on the OPC and a non-image-forming mode in which no image is formed, the method comprising:

determining whether the image forming apparatus is in the non-image-forming mode; and when the image forming apparatus is in the non-image-forming mode, regulating a supply of voltage to at least one of the charge unit and the developing unit to cause the developer unit to collect residual developer from a surface of the OPC, such that an absolute value of a non-image forming charge voltage is larger than that of an image forming charge voltage.

14. The method according to claim 13, wherein the step of regulating the supply of voltage comprises:

supplying a first voltage to the charge unit, the first voltage having a larger absolute value than a charging voltage that is applied to the charge unit when the image forming apparatus is in the image forming mode; and supplying a second voltage to the developing unit, the second voltage having a smaller absolute value than a developing voltage that is applied to the developing unit when the image forming apparatus is in the image forming mode.

15. The method according to claim 14, wherein the image forming apparatus further includes a transfer unit configured to transfer the developer image formed on the OPC to a printing medium, and wherein the first voltage is applied to the charge unit within a first duration of time in which a point on the surface of the OPC moves from a first location adjacent the transfer unit to a second location adjacent the charge unit, and wherein the second voltage is applied to the developing unit within a second time duration in which the point on the surface of the OPC moves from the second location adjacent the charge unit to a third location adjacent the developing unit.

16. The method according to claim 13, wherein the step of regulating the supply of voltage comprises:

supplying a first voltage to the charge unit, the first voltage having a larger absolute value than a charging voltage that is applied to the charge unit when the image forming apparatus is in the image forming mode.

17. The method according to claim 16, wherein the image forming apparatus further includes a transfer unit configured to transfer the developer image formed on the OPC to a printing medium, the method further comprising:

supplying a third voltage to the transfer unit when the image forming apparatus is in the non-image-forming mode, the third voltage having a polarity opposite to that of the transfer voltage that is supplied to the transfer unit during the transfer of the developer image formed on the OPC to the printing medium, and wherein the first voltage is applied to the charge unit within a time duration in which a point on the surface of the OPC moves from a first location adjacent the transfer unit to a second location adjacent the charge unit after supplying of the third voltage to the transfer unit has begun.

18. The method according to claim 13, wherein the step of regulating the supply of voltage comprises:

supplying a second voltage to the developing unit, the second voltage having a smaller absolute value than a developing voltage that is applied to the developing unit when the image forming apparatus is in the image forming mode.

19. The method according to claim 18, wherein the image forming apparatus further includes a transfer unit configured to transfer the developer image formed on the OPC to a printing medium, the method further comprising:

supplying a third voltage to the transfer unit when the image forming apparatus is in the non-image-forming mode, the third voltage having a polarity opposite to that of the transfer voltage that is supplied to the transfer unit during the transfer of the developer image formed on the OPC to the printing medium, and wherein the second voltage is applied to the developing unit within a time duration in which a point on the surface of the OPC moves from a first location adjacent the transfer unit to a second location adjacent the developing unit after supplying of the third voltage to the transfer unit has begun.

20. The method according to claim 13, wherein the image forming apparatus further includes a transfer unit configured to transfer the developer image formed on the OPC to a printing medium, the method further comprising:

supplying a third voltage to the transfer unit when the image forming apparatus is in the non-image-forming mode, the third voltage having a polarity opposite to that of the transfer voltage that is supplied to the transfer unit during the transfer of the developer image formed on the OPC to the printing medium.

21. The method according to claim 13, further comprising:

cleaning the charge unit, wherein the step of regulating the supply of voltage when the image forming apparatus is in the non-image-forming mode is performed at least one of before and after the step of cleaning the charge unit.

22. The method according to claim 21, wherein the step of cleaning the charge unit comprises:

interrupting voltage supply to the charge unit and to the developing unit.

23. The method according to claim 22, wherein the step of interrupting voltage supply comprises interrupting voltage supply to the charge unit first prior to interrupting voltage supply to the developing unit.

24. A method of controlling an image forming apparatus that includes a charge unit, a developing unit, and an organic photo conductor (OPC), image forming apparatus having an image forming mode in which a developer image is formed on the OPC and a non-image-forming mode in which no image is formed, the method comprising:

when the image forming apparatus is in the image non-forming mode, supplying a first voltage to the charge unit, the first voltage having a larger absolute value than a charging voltage that is applied to the charge unit when the image forming apparatus is in the image forming mode;

supplying a second voltage to the developing unit, the second voltage having a smaller absolute value than a developing voltage that is applied to the developing unit when the image forming apparatus is in the image forming mode; and cleaning the charge unit by interrupting voltage supply to the charge unit and to the developing unit.

25. The method according to claim 24, wherein the step of cleaning the charge unit comprises interrupting voltage supply to the charge unit first prior to interrupting voltage supply to the developing unit.

* * * * *